US006776587B2

(12) United States Patent
Meyer et al.

(10) Patent No.: US 6,776,587 B2
(45) Date of Patent: Aug. 17, 2004

(54) DUAL-STAGE, PLUNGER-TYPE PISTON COMPRESSOR WITH MINIMAL VIBRATION

(75) Inventors: Frank Meyer, München (DE); Michael Hartl, Unterhaching (DE); Stefan Schneider, Freital (DE)

(73) Assignee: Knorr-Bremse Systeme für Schienenfahrzeuge GmbH, Munich (DE)

( * ) Notice: Subject to any disclaimer, the term of this patent is extended or adjusted under 35 U.S.C. 154(b) by 0 days.

(21) Appl. No.: 10/168,343

(22) PCT Filed: Dec. 20, 2000

(86) PCT No.: PCT/EP00/12994

§ 371 (c)(1),
(2), (4) Date: Sep. 10, 2002

(87) PCT Pub. No.: WO01/46585

PCT Pub. Date: Jun. 28, 2001

(65) Prior Publication Data

US 2003/0108435 A1 Jun. 12, 2003

(30) Foreign Application Priority Data

Dec. 21, 1999 (DE) ..... 199 61 646

(51) Int. Cl.[7] ..... F04B 25/00
(52) U.S. Cl. ..... 417/248; 417/255
(58) Field of Search ..... 417/248, 255, 417/258

(56) References Cited

U.S. PATENT DOCUMENTS

| | | | | | |
|---|---|---|---|---|---|
| 1,185,942 | A | * | 6/1916 | Reisner | 417/248 |
| 1,445,073 | A | * | 2/1923 | Domenico et al. | 417/255 |
| 2,093,295 | A | * | 9/1937 | Teeter | 417/248 |
| 2,141,057 | A | * | 12/1938 | Whiles | 417/248 |
| 3,744,934 | A | * | 7/1973 | Ueno | 417/237 |

FOREIGN PATENT DOCUMENTS

| | | | |
|---|---|---|---|
| CH | 200769 | * | 1/1939 |
| DE | 765994 | * | 1/1953 |
| FR | 1239385 | * | 7/1960 |

* cited by examiner

*Primary Examiner*—Michael Koczo
(74) *Attorney, Agent, or Firm*—Barnes & Thornburg LLP

(57) ABSTRACT

The invention relates to a piston arrangement for a dual-stage piston compressor, comprising a cranksbaft and several cylinders which house the operating piston. Said arrangement allows two or more low-pressure stages and at least one high-pressure stage to be formed. The invention is characterized in that the two or more low-pressure cylinders are arranged in relation to the high-pressure stage in such a way that said two or more low-pressure cylinders are in phase or are offset by less than ±15° and compress in a position which is offset by 180°±20, in relation to one or more high-pressure cylinders.

13 Claims, 5 Drawing Sheets

DUAL-STAGE, PLUNGER-TYPE PISTON COMPRESSOR WITH MINIMAL VIBRATION

The invention relates to a piston arrangement for a dual-stage piston compressor, having a crankshaft, several cylinders with pistons operating therein, two or more low-pressure stages and at least one high-pressure stage being formed as well as a piston compressor for rail vehicles with such a piston arrangement.

The arrangement according to German Patent Document DE-PS 765 994 is characterized in that the cylinders and the crank throws are designed such that the forces of due to inertia are balanced as well as possible. Gas forces are not mentioned as vibration-exciting components. An assignment of the individual cylinders to a respective compressor stage does not take place in this citation. A piston compressor having a crankshaft, several cylinders and pistons operating therein is known, for example, from German Patent Document DE-PS 765 994.

Light-weight designs are increasingly used in the construction of rail vehicles. Modern light-weight car body structures made, for example, of extruded aluminum profiles or support structures made of thin metal sheet frequently have natural frequencies close to the rotational speed of the compressor of the air supply system. The use of piston compressors is often not possible in the case of such constructions because the permissible structure-borne noise level is frequently exceeded.

This is a result of the fact that, based on their construction, piston engines generate inertia forces and moments caused by the oscillating masses at the crank mechanism as well as moments resulting from the gas forces. Particularly in the case of the dual-stage piston compressors frequently used in the rail vehicle field, a very non-uniform torque will occur. As indicated by the analysis of a typical load moment of such a compressor, the predominant fraction of the load moment corresponds to the rotary frequency of the piston engine which is frequently in the range of from 20 to 30 Hz. These frequencies, in turn, are very easily noticeable to a person situated in the vehicle occupant compartment because, for example, the natural frequency of legs with stretched-out knees may amount to approximately 20 Hz.

In coordination with the engine, the above-described load moment of a piston compressor generates an exciting torque about the axis of rotation of the compressor. The moment of inertia of a conventional piston compressor unit is significantly lower about the axis of rotation than about other axes. Because the transmission mode of an elastic bearing about the longitudinal axis of the compressor, as a rule, is closer to the rotary frequency than, for example, the vertical mode, which plays a greater role for the transmission of inertia forces, this torsional vibration is, as a rule, not insulated as well as other exciter components.

It is an object of the invention to provide a piston compressor engine which avoids the above-described disadvantages.

According to the invention, this problem is solved by a drastic reduction of the fraction of the first order in the load moment resulting predominantly from the gas forces in that, as a result of an unusual piston arrangement, two or more low-pressure stages are superimposed in an in-phase manner and operate offset by approximately 180 (degrees? translator) with respect to the high-pressure stage. Constructively, this is achieved in that, in the case of a piston arrangement for a dual-stage piston compressor having a crankshaft and several cylinders with pistons operating therein, in which case two or more low-pressure cylinders and at least one high-pressure cylinder are constructed, the two or three or more low-pressure cylinders are arranged with respect to the high-pressure cylinders such that the two or more low-pressure cylinders compress in-phase or offset by less than ±15 and offset by 180±20 with respect to one or more high-pressure cylinders.

The inventors have recognized that also, as a result of the phase shift of all low-pressure cylinders with respect to one or more high-pressure cylinders, a drastic reduction of the first order resulting from the torque diagram is achieved and thus a drastic reduction of the vibration-exciting torque about the axis of rotation of the compressor.

In a first embodiment of the invention, the piston arrangement is an oil-lubricated piston arrangement.

However, it is particularly preferable that the piston arrangement is an "oil-free" dry-running piston arrangement. In a special further development of the invention, the piston arrangement is constructed as a 3-cylinder arrangement with two low-pressure cylinders and one high-pressure cylinder, an additional low-pressure cylinder being situated opposite a high-pressure cylinder. Such an arrangement is particularly installation-space saving. Naturally, 4, 5 or 6-cylinder arrangements using the teaching according to the invention are also conceivable.

In an advantageous embodiment, by means of using heavy pistons, the pressure peaks in the torque diagram can clearly be reduced because an increased kinetic energy of the piston is converted to compression work. In particular, the pistons of the cylinders should have such a large mass that the pressure peaks in the tangential force diagram are reduced, in which case the inertia forces entering the tangential force diagram with respect to the pressure peak are in the rotational speed range of 1,000 l/min to 2,000 l/min typical of piston compressors, particularly 1,500 l/min higher than 15% of the gas forces with respect to the pressure peak. In the present application, the tangential force diagram is the torque course/crank throw.

In an advantageous embodiment, it is provided that, for example, in a 3-cylinder arrangement, the masses of the low-pressure cylinder situated on the side of the high-pressure cylinder, specifically the piston mass and/or connecting rod mass are selected such that they balance the opposite low-pressure piston as well as the high-pressure piston which are both disposed on the same crankshaft throw. In this case, the balancing can take place at the piston as well as at the connecting rod. As a result of the increase of the piston mass resulting from the balancing of masses, the bearing load at the connecting rod is reduced.

In addition to the balancing of masses by means of additional masses, it is also possible to balance the oscillating mass by means of a dummy piston running along. In the present application, a dummy piston is a piston which carries out no compression work.

Advantageously, the pistons are arranged such that the low-pressure pistons take in by way of the crankcase in an in-phase manner, during the intake operation, the two low-pressure stages plunging into the crankcase pushing the air into the compression space. As a result, the intake vacuum in the low-pressure stage is reduced and the charging is improved. In a particularly advantageous embodiment, this effect is intensified by the use of a return valve at the inlet connection piece from the air filter housing to the crankcase. The arrangement of a return valve improves the efficiency particularly of a dry-running piston arrangement.

In addition to the piston arrangement, the invention also provides a piston compressor, particularly for rail vehicles comprising such a piston arrangement, which piston compressor advantageously comprises an electric-motor drive. The piston arrangement can also be used in the case of compressed-air generating systems in the industrial field.

In the following, the invention will be explained by means of the drawings.

Figure 5A:
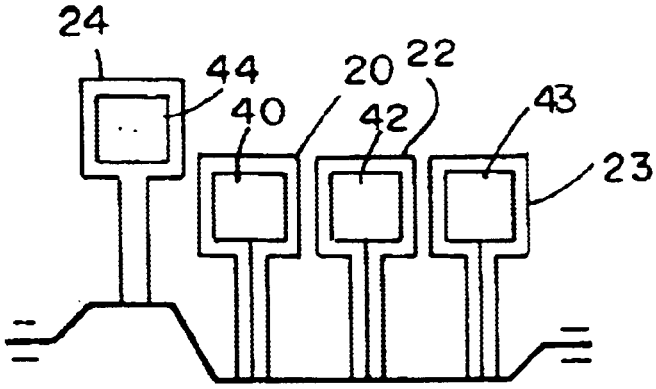
Figure 5B:
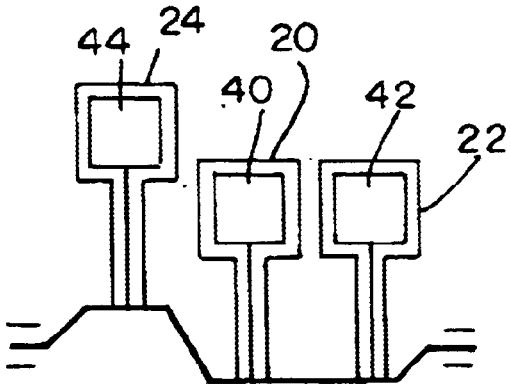
Figure 6:
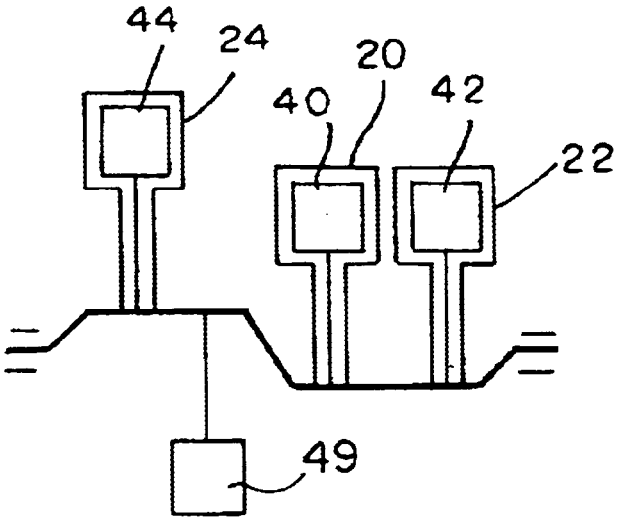

FIGS. 4*a* to 4*d* are views of possible embodiments of piston arrangements according to the invention constructed as opposed-cylinder compressors;

FIGS. 5*a* to 5*b* are views of an embodiment of piston arrangements according to the invention constructed as an in-line engine;

FIG. 6 is a view of an embodiment of a piston arrangement with a dummy piston;

FIG. 7 is a view of amplitudes of the compressor vibration in the vertical direction for an embodiment according to the prior art and the invention.

Figure 1:
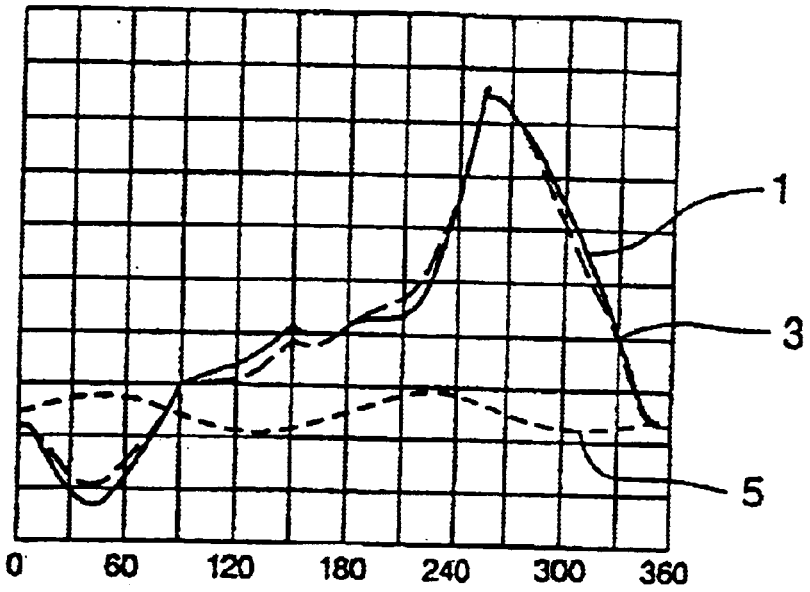
Fig.1 PRIOR ART
FIG. 1 is a view of the tangential force course of a conventional dual-stage piston compressor in an opposed-cylinder arrangement, as known, for example from "DUBBEL, Mechanical Engineering Manual", 15th Edition and 18th Edition respectively, Pages P32 to P33.

FIG. 1 illustrates the tangential force diagram of a piston arrangement, as known from the prior art, for example, as illustrated in "DUBBEL, Mechanical Engineering Manual", 15th Edition and 18th Edition respectively, Pages P32 to P33. In this case, the x-axis indicates the angle of rotation in degrees; the y-axis indicates the applied torque. Reference number 1 indicates the torque from the gas forces; reference number 3 indicates the total torque from the inertia forces and gas forces; and reference number 5 indicates the torque from the inertia forces.

The Fourier analysis of the load moment from the inertia forces and gas forces of a compressor illustrated in FIG. 1 according tothe prior art can be divided into the following fractions:

1st order: 40 Nm

2nd order: 20 Nm

3rd order: 7 Nm

The predominant fraction of the load moment corresponds to the rotary frequency of the piston engine which frequently is at 20, 25 or 30 Hz. These frequencies are easily noticeable to a person, for example, in the vehicle occupant compartment of a rail vehicle. Thus, the natural frequency of legs with stretched-out knees may amount to approximately 20 Hz.

In coordination with.the engine, the load moment of a piston compressor generates an exciting torque about the longitudinal axis of the compressor, in which case the moment of inertia of a conventional piston compressor unit is significantly lower about the longitudinal axis of the compressor than about other axes. The transmission mode of an elastic bearing about the longitudinal axis of the compressor, as a rule, is closer to the rotary frequency than, for example, the vertical mode, which plays a greater role for the transmission of inertia forces. This torsional vibration is, as a rule, not insulated as well as other exciter components.

According to the invention, this vibration problem of conventional piston compressors is solved by a drastic reduction of the fraction of the first order in the load moment resulting predominantly from the gas forces. This reduction of the first order can be achieved by a piston arrangement in the case of which two or more low-pressure stages are superimposed in an in-phase manner and operate offset by approximately 180 (degrees? translator) with respect to the high-pressure stage.

Figure 2:
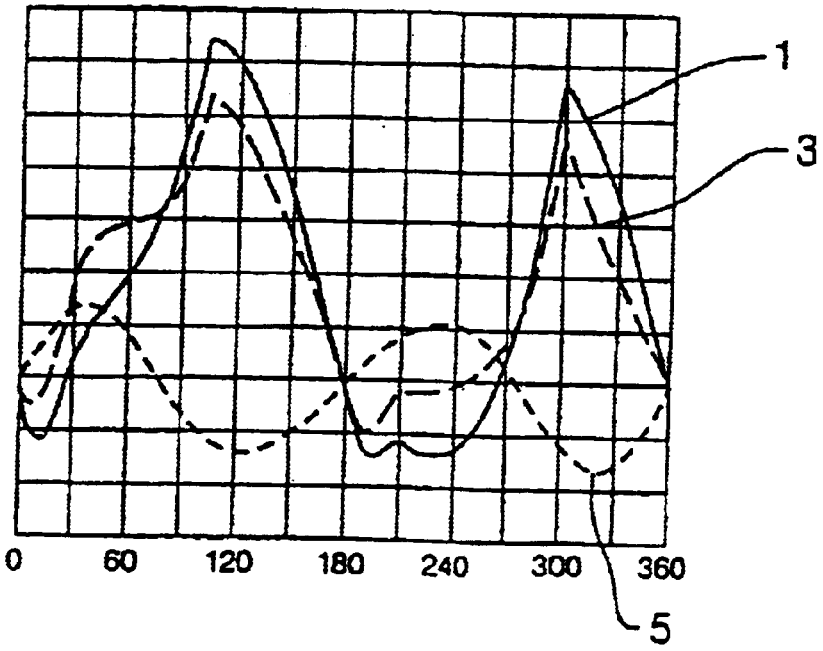
FIG. 2 is a view of the tangential force course of a piston compressor according to the invention.

The tangential force diagram of such an arrangement is illustrated in FIG. 2. As in FIG. 1, reference number 1 indicates the torque from the gas forces; reference number 3 indicates the torque from the inertia forces and gas forces; and reference number 5 indicates the torque from the inertia forces.

The Fourier analysis of the curve according to FIG. 2 has the following result:

1st order: 19 Nm

2nd order: 28 Nm

3rd order: 7 Nm

The fraction of the first order is drastically reduced, which results in a reduced excitation of vibrations about the longitudinal axis of the compressor. The undesirable vibrations in the vehicle occupant compartment can therefore be considerably reduced or, almost completely avoided.

Figure 3:
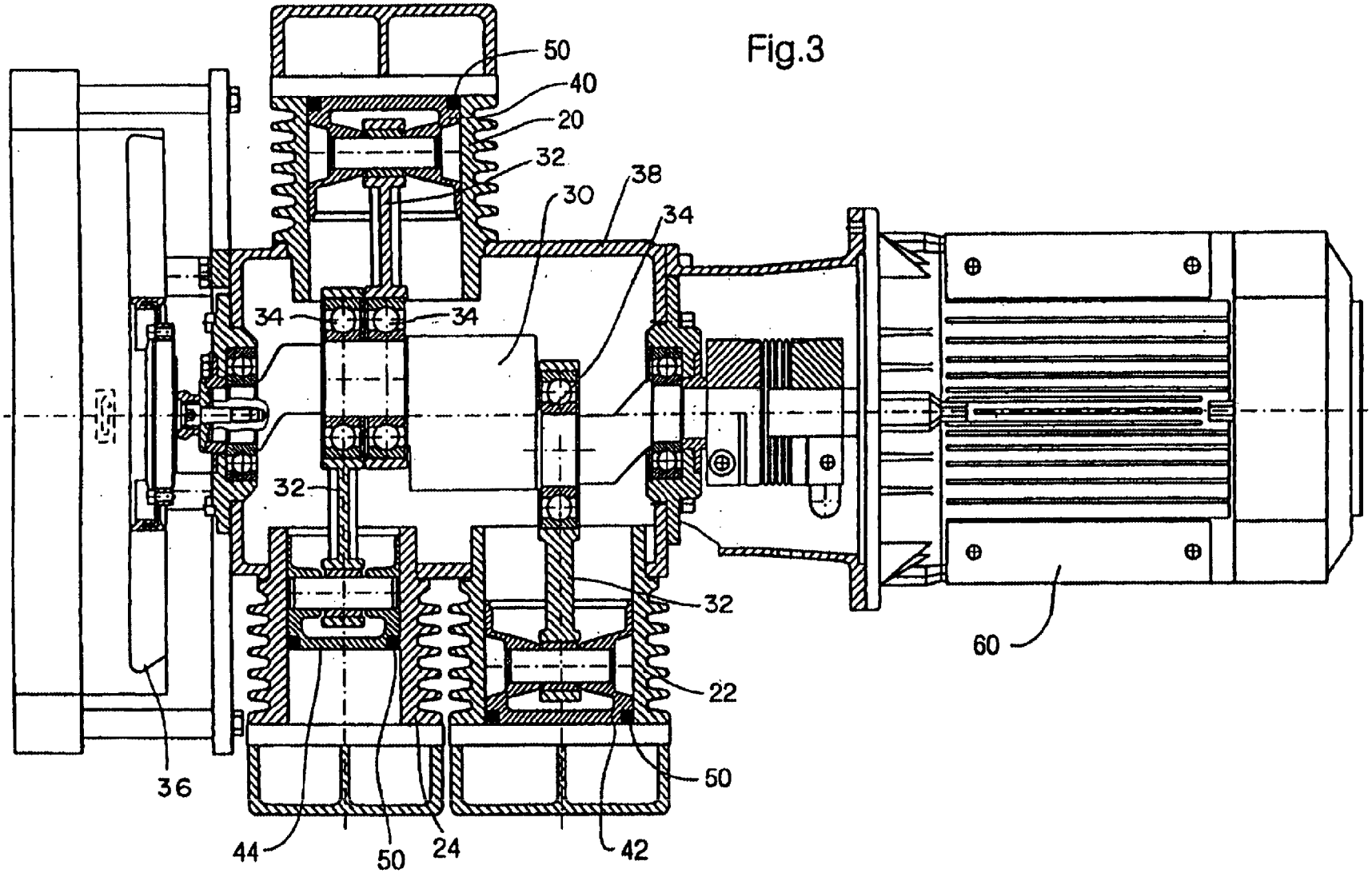
FIG. 3 is a sectional view of a piston compressor according to the invention.

FIG. 3 illustrates an example of a piston compressor having a piston arrangement according to the invention. Without being limited thereto, the embodiment illustrated in FIG. 3 is a 3-cylinder opposed-cylinder arrangement with two low-pressure cylinders 20, 22 forming the low pressure stage as well as a high-pressure cylinder 24 which is arranged in front of one of the low-pressure stages.

The pistons 40, 42, 44 of the three cylinders are disposed on a common crankshaft by way of connecting rods 32 by means of ball or roller bearings 34.

For cooling the arrangement, a fan wheel 36 is provided on the face of the crankshaft 30, which fan wheel 36 provides an air cooling of the case 38 in which the two low-pressure stages as well as the high-pressure stage are arranged, while the crankshaft 30 is rotating.

In the position illustrated in FIG. 3, the pistons 40, 42 of the low-pressure cylinders are in the uppermost position. The high-pressure piston 44 is situated at the upper end of the cylinder. When the crankshaft 30 is moved, the two pistons 40, 42 of the low-pressure cylinders move in-phase and offset by 180 with respect to the piston 44 of the high-pressure stage.

The embodiment illustrated in FIG. 3 is a dry-running piston compressor with an intake air guidance by way of the crankcase. The individual pistons 40, 42, 44 are sealed off with respect to the cylinder by means of sealing elements 50. The drive of the crankshaft 30 takes place by means of an electric motor 60.

In the following, the method of operation of the piston compressor illustrated in FIG. 3 will be described in detail.

During the compression operation in the low-pressure stages, the air volume in the crankcase 38 increases as a result of the large low-pressure pistons 40, 42 plunging in-phase out of the crankcase 38. Air is taken into the crankcase. During the intake of air into the compression space, the low-pressure pistons 40, 42 plunge into the crankcase 38. The volume in the crankcase 38 is reduced at the moment at which air is sucked out of the crankcase 38 into the compression space of the low-pressure stages; that is, the piston underside of the low-pressure pistons 40, 42 pushes air out of the crankcase 38 into the compression spaces of the low-pressure stages. As a result, the intake vacuum in the low-pressure stages is reduced with respect to the embodiments according to the prior art. This effect can be aided when a return valve is used at the intake connection piece of the air filter housing to the crankcase 38, in which case particularly the efficiency is improved.

Another advantage of the piston compressor according to the invention consists of the following.

The considerably fluctuating load moment of the piston compressor generates rotational irregularity. The latter is intensified by the electric motor 60 because the motor 60 reacts in a phase-offset manner to the load peak, specifically when the torque requirement of the compressor is low. The resulting rotational speed fluctuation during one rotation, in the case of piston compressors according to the prior art, may amount to, for example, ±14%. So far, this effect could be reduced only by the use of large balance weights which, however, was undesirable for reasons of weight. Furthermore, the electric motor 60 has a clearly increased power consumption and a drastic reduction of the performance factor—up to 0.6 and therefore has to be overdimensioned in the case of embodiment according to the prior art. By means of the considerable reduction of the first order at the load moment according to the invention, this effect is reduced. The rotational irregularity becomes less, and is reduced from, for example, 0.15 to 0.08 according to the invention. The power consumption of the motor is reduced. In the case of an arrangement according to the invention, the power factor is increased considerably, for example, from power factor=0.7 to 0.8.

In a further developed embodiment, the pressure peaks in the torque diagram can be clearly reduced by the use of heavy pistons because an increased kinetic energy of the piston is converted to compression work. It is particularly preferred for the pistons of the cylinders to have such a high mass that the pressure peaks in the tangential force diagram are reduced, in which case the inertia forces entered into the tangential force diagram; with respect to the pressure peak, are in the rotational speed range between 1,000 l/min and 2,000 l/min larger than 15% of the gas forces with respect to the pressure peak.

In this manner, it is possible to still further reduce the exciting torques in all orders.

In order to achieve a balancing of masses of the oscillating and of the rotating masses, the masses of the low-pressure cylinder situated on the side of the high-pressure cylinder are selected such that they balance the opposed low-pressure piston as well as the high-pressure piston. The balancing may take place at the piston as well as at the connecting rod. As a result of the increase of the piston mass resulting from the balancing of masses, the bearing load at the connecting rod is reduced. This is favorable for the loading at the small end bearing of the low-pressure stage situated on the side of the high-pressure cylinder, because this low pressure stage is not cooled as well because of the adjacent high-pressure stage.

Figure 4A:
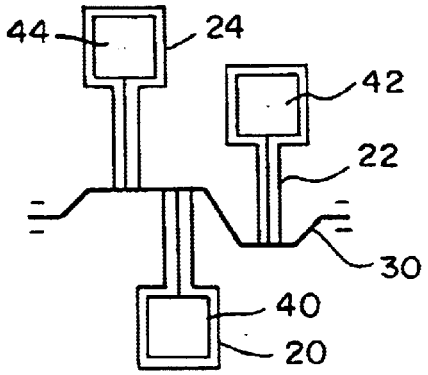
Figure 4B:
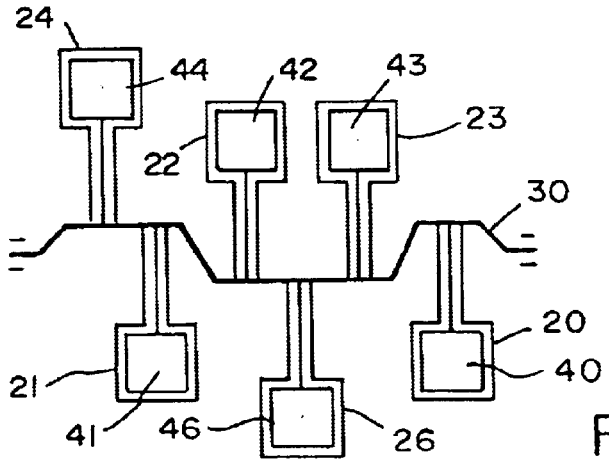
Figure 4C:
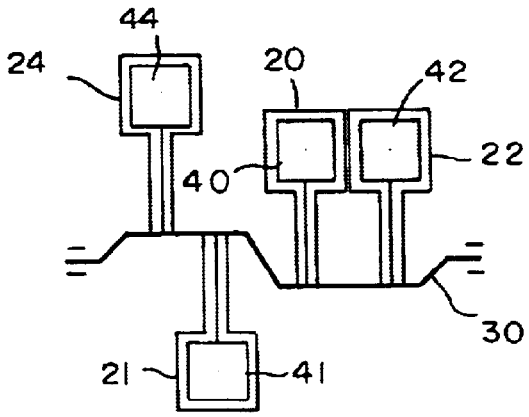
Figure 4D:
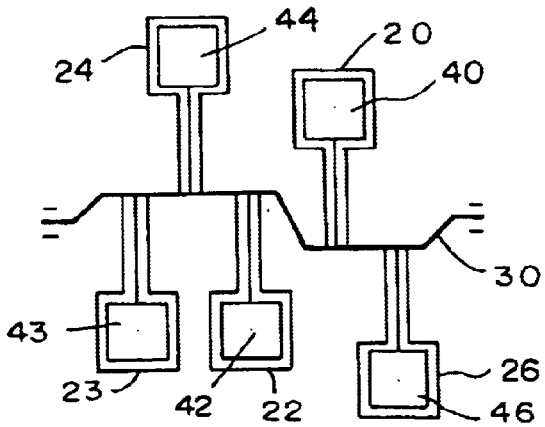

FIGS. 4*a* to 4*d* show arrangements with opposite cylinders according to the invention. FIG. 4*a* shows a 3-cylinder arrangement, as described in detail above. FIG. 4*b* is a 6-cylinder arrangement; FIG. 4*c* shows a 4-cylinder arrangement; and FIG. 4*d* shows a 5-cylinder arrangement according to the invention. The high-pressure pistons have the reference numbers 44, 46 and the low-pressure pistons have the reference numbers 40, 41, 42, 43. The high-pressure cylinders have the reference numbers 24, 26, and the low-pressure cylinders have the reference numbers 20, 21, 22, 23. In addition to the 180 V-piston arrangements, in-line engines are also conceivable.

FIG. 5*a* illustrates a 4-cylinder in-line engine according to the invention. FIG. 5*b* shows a 3-cylinder in-line engine.

FIG. 6 shows a 3-cylinder in-line engine with a running-along dummy piston 50 which performs no compression work and is used only for balancing masses. As in FIGS. 4*a* to 4*d*, the high-pressure pistons have the reference number 44 and the low-pressure pistons have the reference numbers 40, 42; the high-pressure cylinders have the reference number 24 and the low pressure cylinders have the reference numbers 20, 22.

By means of the invention, a piston arrangement and a piston compressor are therefore provided for the first time by means of which the undesirable vibrations of the first order, as they occur in the case of piston compressors of the prior art as a result of compression forces, can be reduced.

Figure 7A:
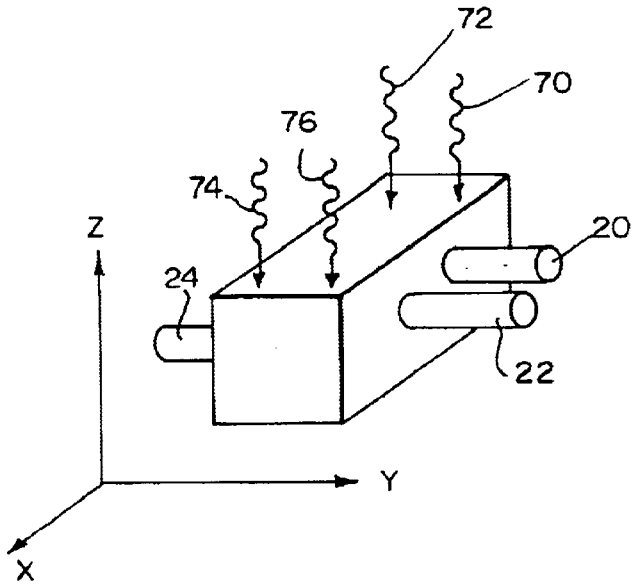
Figure 7B:
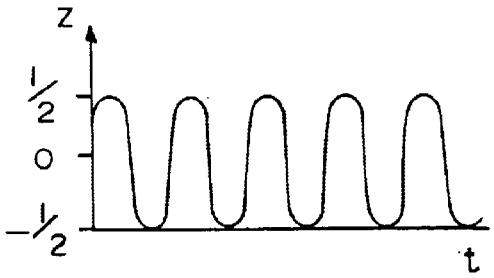
Fig. 7b PRIOR ART
Figure 7C:
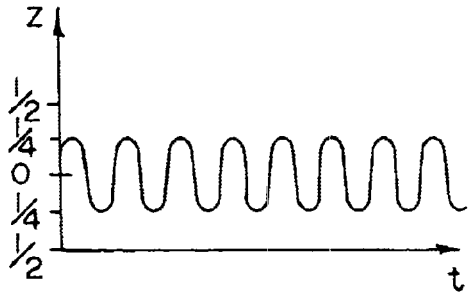

This is particularly well illustrated in FIGS. 7*a* to 7*c*. FIG. 7*a* is a schematic view of a compressor having two low-pressure cylinders 20,22 and one high-pressure cylinder 24 according to the invention. Furthermore, four possible suspensions 70, 72, 74 76 are illustrated, for example, on a rail vehicle. The cylinders are situated in the x-y plane; the z-axis stands perpendicular on the cylinder axis in the direction of the suspensions 70, 72, 74, 76.

FIG. 7*b* shows the time history of the compressor vibration of the 1st order in the z-direction in the case of a compressor according to the prior art. FIG. 7*c* shows the time history of the compressor vibration of the 1st order in the z-direction in the case of a compressor according to the invention. As illustrated by comparing the amplitudes of the vibrations in FIGS. 7*b* and 7*c*, the amplitude of the vibration of the compressor according to the invention is at least cut in half with respect to the prior art. In a particularly preferred embodiment of the invention, the amplitude of a compressor according to the invention amounts to only one third of the amplitude of the compressor according to the prior art.

| List of Reference Numbers | |
|---|---|
| 1 | torque from gas forces |
| 3 | torque from inertia and gas forces |
| 5 | torque from inertia forces |
| 20, 22, 23 | low pressure cylinder |
| 24, 26, 28 | high-pressure cylinder |
| 30 | crankshaft |
| 32 | connecting rod |
| 34 | ball bearing |
| 36 | fan wheel |
| 38 | case |
| 40, 42, 43 | low-pressure piston |
| 44, 46, 48 | high-pressure piston |
| 49 | sealing element |
| 50 | dummy piston |
| 60 | electric motor |
| 70, 72, 75, 76 | suspensions |

We claim:

1. A piston arrangement for a dual-stage piston compressor, comprising:

a crankshaft in a crankshaft housing;

several cylinders having pistons therein;

two or more low-pressure cylinders forming a low-pressure stage and at least one high-pressure cylinder forming a high-pressure stage;

the low-pressure cylinders being arranged with respect to the high-pressure cylinder such that the low-pressure cylinders compress in-phase within an offset of less than ±15 degrees to each other, and are offset by 180 degrees ±20 degrees with respect to the at least one high pressure cylinder; and the piston cylinder arrangement of the low-pressure stage being constructed such that, in an intake operation, the pistons of the low-pressure stage move in the direction of the crankshaft thereby compressing the air in an interior space of the crankshaft housing, and thus air from the interior space of the crankshaft housing is taken into a compression space of the low-pressure cylinders.

2. The piston arrangement according to claim 1, wherein the piston arrangement is an oil-lubricated piston arrangement.

3. The piston arrangement according to claim 1, wherein the piston arrangement is a dry-running piston arrangement.

4. The piston arrangement according to claim 1 wherein the piston arrangement is one of a 6-cylinder, 5-cylinder, 4-cylinder and 3-cylinder arrangement with two or more low-pressure cylinders and one or more high-pressure cylinders.

5. The piston arrangement according to claim 1 wherein the piston arrangement is constructed as a 3-cylinder arrangement which comprises two low-pressure cylinders and one high-pressure cylinder with a low-pressure cylinder being situated opposite a high-pressure cylinder and a low-pressure cylinder.

6. The piston arrangement according to claim 1 wherein the pistons of the cylinders have such a large mass that the inertia forces in a pressure peak of a compression operation, in the rotational speed range between 1,500 RPM and 2,000 RPM, are greater than 15% of gas forces in the pressure peak.

7. The piston arrangement according to of claim 1 wherein a balancing of oscillating masses is carried out by means of additional masses at at least one of the pistons.

8. The piston arrangement according to claim 1 wherein the balancing of the oscillating mass includes the use of a dummy piston.

9. The piston arrangement according to claim 1 wherein a balancing of masses includes the use of additional masses on the crankshaft.

10. The piston arrangement according to claim 1 wherein a return valve is arranged at an inlet opening to the crankcase.

11. The piston arrangement according to of claim 1 wherein a balancing of oscillating masses is carried out by means of additional masses at at a connecting rod.

12. A piston compressor, particularly for rail vehicles, having a piston arrangement comprising:

a crankshaft in a crankshaft housing;

several cylinders having pistons therein;

two or more low-pressure cylinders forming a low-pressure stage and at least one high-pressure cylinder forming a high-pressure stage;

the low-pressure cylinders being arranged with respect to the high-pressure cylinder such that the low-pressure cylinders compress in-phase within an offset of less than ±15 degrees to each other, and are offset by 180 degrees ±20 degrees with respect to the at least one high pressure cylinder; and the piston cylinder arrangement of the low-pressure stage being constructed such that, in an intake operation, the pistons of the low-pressure stage move in the direction of the crankshaft thereby compressing the air in an interior space of the crankshaft housing, and thus air from the interior space of the crankshaft housing is taken into a compression space of the low-pressure cylinders.

13. The piston compressor according to claim 12, wherein the piston compressor comprises an electric-motor drive.

* * * * *